US005422213A

United States Patent [19]

Yu et al.

[11] Patent Number: 5,422,213

[45] Date of Patent: Jun. 6, 1995

[54] MULTILAYER ELECTROPHOTOGRAPHIC IMAGING MEMBER HAVING CROSS-LINKED ADHESIVE LAYER

[75] Inventors: Robert C. U. Yu, Webster; Donald P. Sullivan, Rochester; Kathleen Carmichael, Williamson; Neil S. Patterson, Pittsford, all of N.Y.

[73] Assignee: Xerox Corporation, Stamford, Conn.

[21] Appl. No.: 930,631

[22] Filed: Aug. 17, 1992

[51] Int. Cl.[6] ..... G03G 15/04

[52] U.S. Cl. ..... 430/60; 430/58; 430/64; 430/131; 156/331.7

[58] Field of Search ..... 430/58, 64, 131, 60; 156/331.7

[56] References Cited

U.S. PATENT DOCUMENTS

| | | | |
|---|---|---|---|
| 3,121,006 | 2/1964 | Middleton et al. | 96/1 |
| 3,357,989 | 12/1967 | Byrne et al. | 260/314.5 |
| 3,442,781 | 5/1969 | Weinberger | 204/181 |
| 4,265,990 | 5/1981 | Stolka et al. | 430/59 |
| 4,286,033 | 8/1981 | Neyhart et al. | 430/58 |
| 4,291,110 | 9/1981 | Lee | 430/59 |
| 4,338,387 | 7/1982 | Hewitt | 430/58 |
| 4,587,189 | 5/1986 | Hor et al. | 430/59 |
| 4,664,995 | 5/1987 | Horgan et al. | 430/59 |
| 4,786,570 | 11/1988 | Yu et al. | 430/58 |
| 4,943,508 | 7/1990 | Yu | 430/129 |
| 5,089,364 | 2/1992 | Lee et al. | 430/58 |

FOREIGN PATENT DOCUMENTS

| | | |
|---|---|---|
| 0435634 | 7/1991 | European Pat. Off. . |
| 1010260 | 1/1989 | Japan . |

*Primary Examiner*—S. Rosasco
*Attorney, Agent, or Firm*—Oliff & Berridge

[57] ABSTRACT

An electrophotographic imaging member is characterized by a cross-linked adhesive layer and a charge generating layer applied onto the adhesive layer by solution coating.

35 Claims, 1 Drawing Sheet

MULTILAYER ELECTROPHOTOGRAPHIC IMAGING MEMBER HAVING CROSS-LINKED ADHESIVE LAYER

BACKGROUND OF THE INVENTION

This invention relates in general to electrophotography and, in particular, to electrophotoconductive imaging members having multiple layers.

In electrophotography, an electrophotographic plate, drum, belt or the like (imaging member) containing a photoconductive insulating layer on a conductive layer is imaged by first uniformly electrostatically charging its surface. The imaging member is then exposed to a pattern of activating electromagnetic radiation such as light. The radiation selectively dissipates the charge on the illuminated areas of the photoconductive insulating layer while leaving behind an electrostatic latent image on the non-illuminated areas. This electrostatic latent image may then be developed to form a visible image by depositing finely divided electroscopic marking particles on the surface of the photoconductive insulating layer. The resulting visible image may then be transferred from the imaging member directly or indirectly to a support such as paper. This imaging process may be repeated many times with reusable imaging members.

An electrophotographic imaging member may be provided in a number of forms. For example, the imaging member may be a homogeneous layer of a single material such as vitreous selenium or it may be a composite layer containing a photoconductor and another material. A layered photoreceptor having separate photogenerating and charge transport layers is disclosed in U.S. Pat. No. 4,265,990. The photogenerating layer is capable of photogenerating charge and injecting the photogenerated charge into the charge transport layer.

As more advanced, higher speed electrophotographic copiers, duplicators and printers were developed, degradation of image quality was encountered during extended cycling. Moreover, complex, highly sophisticated duplicating and printing systems operating at very high speeds have placed stringent requirements, including narrow operating limits, on photoreceptors.

The numerous layers found in many modern photoconductive imaging members must be highly flexible, adhere well to adjacent layers and exhibit predictable electrical characteristics within narrow operating limits to provide excellent toner images over many thousands of cycles. One type of multilayered photoreceptor that has been employed as a belt in electrophotographic imaging systems comprises a substrate, a conductive layer, a blocking layer, an adhesive layer, a charge generating layer, and a charge transport layer. This photoreceptor may also comprise additional layers such as an anti-curl backing layer and an overcoating layer.

One problem associated with multilayer electrophotographic imaging members is delamination. Since the various layers of a multilayer electrophotographic imaging member contain differing materials, the adhesion of these layers to one another will vary. In particular, it is desirable to provide an adhesive layer between the charge blocking layer and the charge generating layer since adequate adhesion may not be obtained when certain materials are used for these layers.

A number of materials have been provided for the adhesive layer. For example, copolyesters such as du Pont 49,000 resin available from E. I. du Pont de Nemours & Company and Vitel PE-100, Vitel PE-200, Vitel PE-200D and Vitel PE-222 resins, all available from Goodyear Rubber and Tire Company, are commonly employed. With such polyesters, adhesion may be increased in proportion with the thickness of the adhesive layer.

U.S. Pat. No. 4,786,570 to Yu discloses an exemplary electrophotographic imaging member. The electrophotographic imaging member comprises a flexible substrate, a hole blocking layer comprising an amino silane reaction product, and an adhesive layer having a thickness between about 200 angstroms and about 900 angstroms consisting essentially of at least one copolyester resin having the following formula:

$$HOC\overset{O}{\overset{\|}{}}-(\text{diacid-diol})_n-OH$$

wherein the diacid is selected from the group consisting of terephthalic acid, isophthalic acid and mixtures thereof, the diol comprises ethylene glycol, the mole ratio of diacid to diol is 1 to 1, n is a number between about 175 and about 350 and the Tg of the copolyester resin is between about 50° C. to about 80° C. The imaging member also includes a charge generating layer comprising a film forming polymeric component, and a diamine hole transport layer, the hole transport layer being substantially non-absorbing in the spectral region at which the charge generating layer generates and injects photogenerated holes but being capable of supporting the injection of photogenerated holes from the charge generation layer and transporting the holes through the charge transport layer.

In general, adhesive layers provide adequate adhesive bond strength linking of the charge generating layer to the charge blocking layer. However, certain charge generating layers do not exhibit adequate adhesion with commonly used adhesive layers. This adhesion problem may be due to the particular constituents of the charge generating layer or to the processes used to produce the layer. For example, charge generating layers containing dispersions of phthalocyanines or benzimidazole perylenes in polymer binders exhibit poor adhesion with adhesive layers. Benzimidazole perylene is a photogenerating pigment of interest because of improved photogenerating characteristics. Further, particles of benzimidazole perylene may be dispersed in a dissolved polymer in solvent system and applied as a dispersion solution coating, a process that avoids cracking of the charge generating layer which may occur upon application of the charge transport layer. However, adhesion as provided by an adhesive layer between a charge blocking layer and a charge generating layer containing benzimidazole perylene, especially in desirable high concentrations, is substantially reduced and the resulting electrophotographic imaging members are highly susceptible to layer delamination during imaging belt machine functions.

SUMMARY OF THE INVENTION

The present invention provides an electrophotographic imaging member with improved adhesion of the adhesive layer without adverse effect on the electrical integrity of the resulting device. The imaging member comprises an at least partially cross-linked adhesive layer and a solution coated charge generating layer. Cross-linking of the adhesive layer provides sites for chemical bonding, mechanical polymer entanglement or a combination of chemical bonding and mechanical polymer entanglement with the applied charge generating layer. The bonding and/or mechanical polymer entanglement permits the adhesive layer to provide improved adhesion to the charge generating layer. The adhesive layer may be interfacially cross-linked by chemical bonding of at least a portion of a cross-linking agent in the adhesive layer with at least a portion of the binder resin of the charge generating layer. The improved adhesion may be imparted by an interphase interlocking by mechanical polymer entanglement of at least a portion of the cross-linked adhesive layer with at least a portion of the binder resin of the charge generating layer. Finally, adhesion may be improved by both a cross-linking by chemical bonding of the cross-linking agent and by a mechanical polymer entanglement of at least a portion of the adhesion layer with portions of the binder.

In the instance the layers are interfacially cross-linked by chemical bonding, the chemical reaction interconnects polymeric molecules from each of the charge generating layer and the adhesive layer into a three-dimensional network. The resulting fully cross-linked structure becomes essentially one molecule, thereby chemically interconnecting the charge generating layer to the adhesive layer.

When the charge generating layer is applied by solution coating with a solvent for the adhesive layer, the solvent partially swells the adhesive layer to form an interphase. It is believed that the binder polymers of the charge generating layer penetrate into the swollen interphase, and, if cross-linkable, the polymers react to form the three-dimensional network. If the binder resin polymers are not cross-linkable or if chemical binding sites of the cross-linking agent have been exhausted in the adhesive layer cross-linking, the polymers may penetrate through the voids of the adhesive layer network and become interlocked by entanglement within the lattice-like network structure. Chemical cross-linking, mechanical polymer entanglement and combinations of cross-linking and entanglement, impart an improved adhesion between layers.

Additionally, the present invention relates to a process for preparing an electrophotographic imaging member comprising adding a cross-linking agent to an adhesive layer and reacting the agent with a polyester adhesive resin to at least partially cross-link the adhesive layer. The charge generating layer is applied onto the adhesive layer and reacted with the cross-linking agent, or the polymers entangled mechanically with the adhesive network structure, or both reacted and entangled.

In addition to elimination of the aforementioned delamination problem, the formulations of the present invention produce no adverse electrical impact. For example, in testing, characteristic electrical properties unique to a dispersion coated benzimidazole perylene photoreceptor are maintained after 50,000 cycles.

BRIEF DESCRIPTION OF THE DRAWING

The accompanying FIGURE is a cross-sectional view of a multilayer photoreceptor of the invention.

DESCRIPTION OF PREFERRED EMBODIMENTS

Figure 1:
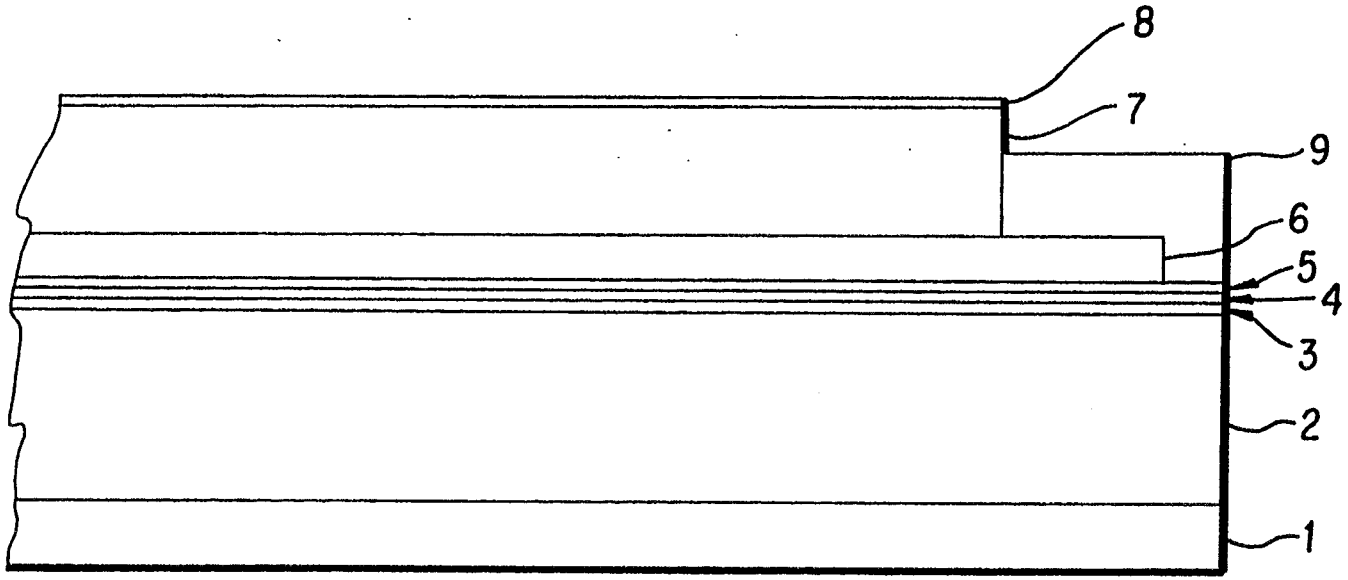

The present invention increases adhesion between layers of an electrophotographic imaging member, in particular, between a charge generating layer and a charge blocking layer through an improved interfacial cross-linked bonding between the charge generating layer and an interposed adhesive layer. The increased adhesion of layers is obtained without adverse effects on the electrical integrity of the imaging member. In particular, the adhesive layer is cross-linked to the binder of the charge generating layer.

In one embodiment of the present invention, an electrophotographic imaging member is provided having improved adhesion comprising a supporting substrate, a conductive layer, a charge blocking layer, an adhesive layer, a charge generating layer and a charge transport layer. In this embodiment, improved adhesion between the charge generating layer and the adhesive layer is provided by a molecular cross-linking process interfacially between the layers.

A representative structure of an electrophotographic imaging member of the present invention is shown in FIG. 1. This imaging member is provided with an anti-curl layer 1, a supporting substrate 2, an electrically conductive ground plane 3, a charge blocking layer 4, an adhesive layer 5, a charge generating layer 6, a charge transport layer 7 and an overcoating layer 8.

In the above-described device, a ground strip 9 is preferably provided adjacent the charge transport layer at an outer edge of the imaging member. See U.S. Pat. No. 4,664,995. The ground strip 9 is coated adjacent to the charge transport layer so as to provide grounding contact with a grounding device (not shown) during electrophotographic processes.

A description of the layers of the electrophotographic imaging member of the present invention shown in FIG. 1 follows.

The Supporting Substrate

The supporting substrate 2 may be opaque or substantially transparent and may comprise numerous suitable materials having the required mechanical properties. The substrate may further be provided with an electrically conductive surface (ground plane 3). Accordingly, the substrate may comprise a layer of an electrically non-conductive or conductive material such as an inorganic or an organic composition. As electrically non-conducting materials, there may be employed various resins known for this purpose including polyesters, polycarbonates, polyamides, polyurethanes, and the like. For a belt-type imaging member, the electrically insulating or conductive substrate should be flexible and may have any number of different configurations such as, for example, a sheet, a scroll, an endless flexible belt, and the like. Preferably, the substrate is in the form of an endless flexible belt and comprises a commercially available biaxially oriented polyester known as Mylar, available from E. I. du Pont de Nemours & Co., or Melinex available from ICI Americas Inc.

The preferred thickness of the substrate layer depends on numerous factors, including economic considerations. The thickness of this layer may range from about 65 micrometers to about 150 micrometers, and preferably from about 75 micrometers to about 125 micrometers for optimum flexibility and minimum induced surface bending stress when cycled around small diameter rollers, e.g., 19 millimeter diameter rollers.

The substrate for a flexible belt may be of substantial thickness, for example, 200 micrometers, or of minimum thickness, for example 50 micrometers, provided there are no adverse effects on the final photoconductive device. The surface of the substrate layer is preferably cleaned prior to coating to promote greater adhesion of the adjacent layer. Cleaning may be effected by exposing the surface of the substrate layer to plasma discharge, ion bombardment and the like.

The Electrically Conductive Ground Plane

The electrically conductive ground plane 3 (if needed) may be an electrically conductive layer such as a metal layer which may be formed, for example, on the substrate 2 by any suitable coating technique, such as a vacuum depositing technique. Typical metals include aluminum, zirconium, niobium, tantalum, vanadium, hafnium, titanium, nickel, stainless steel, chromium, tungsten, molybdenum, and the like, and mixtures and alloys thereof. The conductive layer may vary in thickness over substantially wide ranges depending on the optical transparency and flexibility desired for the electrophotoconductive member. Accordingly, for a flexible photoresponsive imaging device, the thickness of the conductive layer is preferably between about 20 Angstroms to about 750 Angstroms, and more preferably from about 50 Angstroms to about 200 Angstroms for an optimum combination of electrical conductivity, flexibility and light transmission.

Regardless of the technique employed to form a metal layer, a thin layer of metal oxide generally forms on the outer surface of most metals upon exposure to air. Thus, when other layers overlying the metal layer are characterized as "contiguous" layers, it is intended that these overlying contiguous layers may, in fact, contact a thin metal oxide layer that has formed on the outer surface of the oxidizable metal layer. Generally, for rear erase exposure, a conductive layer light transparency of at least about 15 percent is desirable. The conductive layer need not be limited to metals. Other examples of conductive layers may be combinations of materials such as conductive indium tin oxide as a transparent layer for light having a wavelength between about 4000 Angstroms and about 9000 Angstroms or a conductive carbon black dispersed in a plastic binder as an opaque conductive layer. The conductive ground plane 3 may be omitted if a conductive substrate is used.

The Charge Blocking Layer

After deposition of any electrically conductive ground plane layer, the charge blocking layer 4 may be applied thereto. Electron blocking layers for positively charged photoreceptors allow holes from the imaging surface of the photoreceptor to migrate toward the conductive layer. For negatively charged photoreceptors, any suitable hole blocking layer capable of forming a barrier to prevent hole injection from the conductive layer to the opposite photoconductive layer may be utilized.

The blocking layer 4 may include polymers such as polyvinylbutyral, epoxy resins, polyesters, polysiloxanes, polyamides, polyurethanes and the like; nitrogen-containing siloxanes or nitrogen-containing titanium compounds such as trimethoxysilyl propyl ethylene diamine, N-beta-(aminoethyl) gamma-amino-propyl trimethoxy silane, isopropyl 4-aminobenzene sulfonyl titanate, di(dodecylbenzene sulfonyl) titanate, isopropyl di(4-aminobenzoyl)isostearoyl titanate, isopropyl tri(N-ethylaminoethylamino) titanate, isopropyl trianthranil titanate, isopropyl tri(N,N-dimethyl-ethylamino) titanate, titanium-4-amino benzene sulfonate oxyacetate, titanium 4-aminobenzoate isostearate oxyacetate, $[H_2N(CH_2)_4]CH_3Si(OCH_3)_2$ (gamma-aminobutyl methyl dimethoxy silane), $[H_2N(CH_2)_3]CH_3Si(OCH_3)_2$ (gamma-aminopropyl methyl dimethoxy silane), and $[H_2N(CH_2)_3]Si(OCH_3)_3$ (gamma-aminopropyl trimethoxy silane) as disclosed in U.S. Pat. Nos. 4,338,387, 4,286,033 and 4,291,110. A preferred hole blocking layer comprises a reaction product of a hydrolyzed silane or mixture of hydrolyzed silanes and the oxidized surface of a metal ground plane layer. The oxidized surface inherently forms on the outer surface of most metal ground plane layers when exposed to air after deposition. This combination enhances electrical stability at low relative humidity. The hydrolyzed silanes have the general formula:

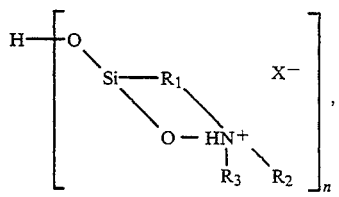

I or

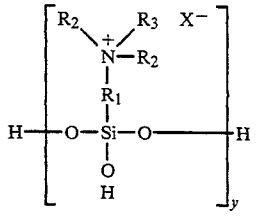

II wherein $R_1$ is an alkylidene group containing 1 to 20 carbon atoms, $R_2$, $R_3$ and $R_7$ are independently selected from the group consisting of H, a lower alkyl group containing 1 to 3 carbon atoms and a phenyl group, X is an anion of an acid or acidic salt, n is 1–4, and y is 1–4.

The blocking layer 4 should be continuous and have a thickness of less than about 0.5 micrometer because greater thicknesses may lead to undesirable high residual voltage. A blocking layer of between about 0.005 micrometer and about 0.3 micrometer is satisfactory because charge neutralization after the exposure step is facilitated and good electrical performance is achieved. A thickness between about 0.03 micrometer and about 0.06 micrometer is preferred for blocking layers for optimum electrical behavior.

The blocking layer 4 may be applied by any suitable technique such as spraying, dip coating, draw bar coating, gravure coating, silk screening, air knife coating, reverse roll coating, vacuum deposition, chemical treatment and the like. For convenience in obtaining thin layers, the blocking layer is preferably applied in the form of a dilute solution, with the solvent being removed after deposition of the coating by conventional techniques such as by vacuum, heating and the like. Generally, a weight ratio of blocking layer material and solvent of between about 0.5:100 to about 5.0:100 is satisfactory for spray coating.

The Adhesive Layer

An intermediate layer 5 between the blocking layer and the charge generating or photogenerating layer is provided to promote adhesion. Preferably, the layer is characterized by a dry thickness between about 0.01 micrometer to about 0.3 micrometer, more preferably about 0.05 to about 0.2 micrometer.

The adhesive layer may comprise any known adhesive for layers of an electrophotographic imaging member so long as it comprises a component that may interfacially cross-link to a component of the charge generating layer or may form a cross-linked network that permits mechanical polymer entanglement with the charge generating layer. The adhesive layer may comprise a film-forming polyester resin adhesive such as du Pont 49,000 resin (available from E. I. du Pont de Nemours & Co.), Vitel 1200 (available from Goodyear Rubber & Tire Co.), or the like. Both the du Pont 49,000 and Vitel 1200 adhesive layers are preferred because they provide reasonable adhesion strength and produce no deleterious electrophotographic impact on the resulting imaging members.

Du Pont 49,000 is a linear saturated copolyester of four diacids and ethylene glycol having a weight average molecular weight of about 70,000 and a glass transition temperature of 32° C. Its molecular structure is represented as $$HO-\overset{\overset{\displaystyle O}{\|}}{C}-(\text{diacid-ethylene glycol})_n-OH$$

where n is a number which represents the degree of polymerization and gives a weight average molecular weight of about 70,000. The ratio of diacid to ethylene glycol in the copolyester is 1:1. The diacids are terephthalic acid, isophthalic acid, adipic acid and azelaic acid in a ratio of 4:4:1:1.

Vitel 1200 is a linear copolyester of two diacids and ethylene glycol having a weight average molecular weight of about 49,000 and a glass transition temperature of 71° C. Vitel 1200 is available from Goodyear Rubber & Tire Co. Its molecular structure is represented as $$HO-\overset{\overset{\displaystyle O}{\|}}{C}-(\text{diacid-ethylene glycol})_n-OH$$

where n is a number which represents the degree of polymerization and gives a weight average molecular weight of about 49,000. The ratio of diacid to ethylene glycol in the copolyester is 1:1. The two diacids are terephthalic acid and isophthalic acid in a ratio of 3:2.

Another copolyester resin adhesive is available from Goodyear Tire & Rubber Co. as Vitel 2200. This polyester resin is a linear saturated copolyester of two diacids and two diols. The molecular structure of this linear saturated copolyester is represented by the following:

$$HO\overset{\overset{\displaystyle O}{\|}}{C}-(\text{diacid-diol})_n-OH$$

where the ratio of diacid to ethylene glycol in the copolyester is 1:1. The diacids are terephthalic acid and isophthalic acid in a ratio of 1.2:1. The two diols are ethylene glycol and 2,2-dimethyl propane diol in a ratio of 1.33:1. The Goodyear Vitel 2200 linear saturated copolyester consists of randomly alternating monomer units of the two diacids and the two diols and has a weight average molecular weight of about 58,000 and a Tg of about 67° C.

Other suitable copolyesters include Goodyear Vitel 1710, Vitel 1870, Vitel 3300, Vitel 3550 and Vitel 5833. Vitel 5833 is a short chained branched polymer having cross-linkable hydroxyl and carboxylic acid functional groups. Vitel 5833 is particularly useful by itself or blended with other polyesters in applications requiring an increase of adhesive layer cross-linking density. Properties of Goodyear Vitel copolyesters are summarized in Table I.

TABLE 1

| VITEL RESIN | Mn | Mw | ACID NUMBER (mg KOH/g) | HYDROXYL NUMBER (mg KOH/g) | Tg (°C.) |
|---|---|---|---|---|---|
| 1200 | 28,000 | 49,000 | 1-3 | 3-6 | 71 |
| 1710 | 42,000 | 71,000 | 1-3 | 3-6 | 27 |
| 1870 | 36,000 | 62,000 | 1-3 | 3-6 | −5 |
| 2200 | 32,000 | 58,000 | 1-3 | 3-6 | 67 |
| 3300 | 40,000 | 69,000 | 1-3 | 3-6 | 14 |
| 3550 | 42,000 | 80,000 | 1-3 | 3-6 | −11 |
| 5833 | 4,600 | 9,800 | 5 | 38 | 48 |

The charge generating (photogenerating) layer 6 of the invention is applied onto the adhesive layer 5. By the present invention, adhesion with the charge generating layer is improved by providing a mechanical and/or chemical linking through formation of a semi or full entangled network or an interfacial bonding.

In a preferred embodiment, the cross-linking is achieved through reaction with a suitable cross-linking agent that will react with hydroxyl or carboxylic acid groups of polyesters in both layers. The cross-linking agent is added with the coating solution to form the adhesive layer prior to application of the charge generating layer solution. If cross-linking with the charge generating layer is intended, care must be taken to avoid complete cross-linking or exhaustion of the cross-linking agent within the adhesive layer.

A cross-linking agent is an element, a group, a compound, for example a polymer which will attach two molecules or chains of molecules by forming a bridge by joinder of functional groups of the molecules by primary chemical bonds.

Suitable cross-linking agents to react with the hydroxyl and carboxylic groups of polyesters include polyisocyanates, melamines, melamine/ureaformaldehyde resins, peroxides and polymethyl acrylaminoglycolate methyl ether. Preferred are polyisocyanates of the general structure RNC=0. Particularly preferred are triisocyanates such as Mondur CB-75 and Desmodur N-75 available from Mobay. Other cross-linking agents include, for example, Cymel 300, Cymel 301, Cymel 303 available from American Cyanamid and Resimene 728 from Monsanto or free radical generating cross-linking agents such as benzoyl peroxide and dicumyl peroxide.

The cross-linking agent is added to the adhesive layer in a weight ratio of agent to layer of between 1 and 16; preferably between 4 and 8. The adhesive layer is heated to effect a first cross-linking reaction between some of the available active sites of the agent and the corresponding reactive sites of the adhesive. This heating is preferably at a temperature between 50° and 150° C. Thereafter the charge generating layer is applied to the adhesive layer. If cross-linking is by chemical bonding, the resulting composition is heated, to between 50° and 150° C., preferably to between 120° and 135° C. for at least five minutes to effect a second cross-linking reaction between the remaining active sites of the agent and corresponding reactive sites of the charge generating layer binder. The heating also assures complete drying of the applied coating layer.

The Charge Generating Layer

Examples of photogenerating materials for the photogenerating layer 6 include inorganic photoconductive particles such as amorphous selenium, trigonal selenium, and selenium alloys selected from the group consisting of selenium-tellurium, selenium-tellurium-arsenic, selenium arsenide and mixtures thereof, and organic photoconductive particles including various phthalocyanine pigments such as the X-form of metal-free phthalocyanine described in U.S. Pat. No. 3,357,989; metal phthalocyanines such as vanadyl phthalocyanine and copper phthalocyanine; dibromoanthanthrone; squarylium; quinacridones such as those available from du Pont under the tradename Monastral Red, Monastral Violet and Monastral Red Y; dibromo anthanthrone pigments such as those available under the trade names Vat orange 1 and Vat orange 3; benzimidazole perylene; substituted 2,4-diamino-triazines such as those disclosed in U.S. Pat. No. 3,442,781; polynuclear aromatic quinones such as those available from Allied Chemical Corporation under the tradenames Indofast Double Scarlet, Indofast Violet Lake B, Indofast Brilliant Scarlet and Indofast Orange; and the like. Other suitable photogenerating materials known in the art may also be utilized, if desired.

Charge generating layers comprising a polymer binder and a photoconductive pigment such as vanadyl phthalocyanine, metal-free phthalocyanine, benzimidazole perylene, amorphous selenium, trigonal selenium, selenium alloys such as selenium-tellurium, selenium-tellurium-arsenic, selenium arsenide, and the like and mixtures thereof are especially preferred because of their sensitivity to white light. Particularly preferred are the perylene pigments disclosed in U.S. Pat. No. 4,587,189. Vanadyl phthalocyanine, metal-free phthalocyanine and tellurium alloys are also preferred because these materials provide the additional benefit of being sensitive to infrared light. When organic pigment such as benzimidazole perylenes or phthalocyanines are used, a high level of pigment loading may be required to provide desired photosensitivity and good electrical characteristics. However, as indicated above, high pigment loading results in weakening of adhesive bond strength to the adhesive layer. The invention is of benefit in any instance in which improved adhesion is necessary or desirable, particularly with imaging members having charge generating layers requiring high pigment loading.

Any suitable film-forming binder material may be employed as the polymer matrix in the photogenerating layer. Typical polymeric film-forming materials include those described, for example, in U.S. Pat. No. 3,121,006. Cross-linkable polymer binder materials are preferred. However, binder materials which do not form a cross-linking chemical bonding with the adhesive layer are also suitable. These materials include polycarbonates, polyarylates, polyacrylates, polysulfones, polyvinyl chloride. polyvinylbutyral, polyurethanes, polysiloxanes, styrene-butadiene copolymers and the like. If the charge generating layer is to be cross-linked to the adhesive layer, preferred polyester binder materials are the same as those utilized in the adhesive layer.

In another preferred embodiment, the binder dissolves in a solvent which also swells the upper surface of the adhesive layer to form an interphase. Typical solvents include tetrahydrofuran, cyclohexanone, methylene chloride, 1,1,1-trichloroethane, 1,1,2-trichloroethane, trichloroethylene, toluene, and the like, and mixtures thereof. Mixtures of solvents may be utilized to control evaporation range. For example, satisfactory results may be achieved with a tetrahydrofuran to toluene ratio of between about 90:10 and about 10:90 by weight. Generally, the combination of photogenerating pigment, binder polymer and solvent should be selected to form uniform dispersions of the photogenerating pigment in the charge generating layer coating composition. The solvent for the charge generating layer binder polymer should dissolve the polymer binder utilized in the charge generating layer and be capable of dispersing the photogenerating pigment particles present in the charge generating layer.

The photogenerating composition or pigment may be present in the resinous binder in various amounts. Generally, from 5 to about 90 percent by volume of the photogenerating pigment is dispersed in about 95 to 10 percent by volume of the resinous binder. Preferably from about 20 percent by volume to about 30 percent by volume of the photogenerating pigment is dispersed in about 80 percent by volume to about 70 percent by volume of the resinous binder composition. However, certain charge generating pigments are preferably present in the layer in much higher percentages, from greater than 20% by volume to between 50% to 90% by volume. Consequently, with such compositions, the proportion of binder in the charge generating layer is substantially reduced compared to typical photogenerating components. Cross-linking, as provided by the present invention, is particularly advantageous with such charge generating layers. Charge generating pigments which are preferably present in higher concentrations include phthalocyanine and benzimidazole perylenes. The phthalocyanines include vanadyl phthalocyanine and metal-free phthalocyanine. The benzimidazole perylenes include the following structures:

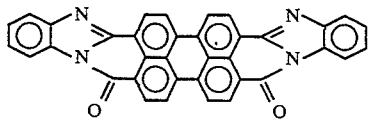

and

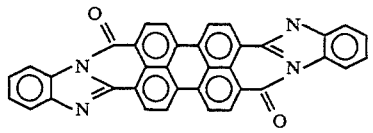

Any suitable and conventional technique may be utilized to mix and thereafter apply the photogenerating layer coating mixture onto the cross-linking agent containing adhesive layer. Suitable techniques include spraying, dip coating, roll coating, wire wound rod coating, and the like. In a preferred technique, the pigment is dispersed in a polymer/solvent solution and applied by solution coating. Drying of the deposited coating may be effected by any suitable conventional technique such as oven drying, infrared radiation drying, air drying and the like, to remove substantially all solvents utilized in applying the coating.

The Charge Transport Layer

The charge transport layer 7 may comprise any suitable transparent organic polymer or non-polymeric material capable of supporting the injection of photogenerated holes or electrons from the charge generating layer 6 and allowing the transport of these holes or electrons to selectively discharge the surface charge. The charge transport layer not only serves to transport holes or electrons, but also protects the charge generating layer from abrasion or chemical attack and therefore extends the operating life of the imaging member.

The charge transport layer should exhibit negligible, if any, discharge when exposed to a wavelength of light useful in xerography, e.g., 4000 Angstroms to 9000 Angstroms. The charge transport layer is substantially transparent to radiation in a region in which the imaging member is to be used. The charge transport layer is normally transparent when exposure is effected therethrough to ensure that most of the incident radiation is utilized by the underlying charge generating layer. When used with a transparent substrate, imagewise exposure or erase may be accomplished through the substrate with all light passing through the substrate. In this case, the charge transport material need not transmit light in the wavelength region of use.

The charge transport layer may comprise activating compounds dispersed in normally electrically inactive polymeric materials for making these materials electrically active. These compounds may be added to polymeric materials which are incapable of supporting the injection of photogenerated charge and incapable of allowing the transport of this charge. An especially preferred transport layer employed in multilayer photoconductors comprises from about 25 percent to about 75 percent by weight of at least one charge transporting aromatic amine compound, and about 75 percent to about 25 percent by weight of a polymeric film-forming resin in which the aromatic amine is soluble.

The charge transport layer is preferably formed from a mixture comprising one or more compounds having the general formula:

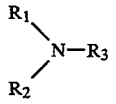

wherein $R_1$ and $R_2$ are selected from the group consisting of substituted or unsubstituted phenyl groups, naphthyl groups, and polyphenyl groups and $R_3$ is selected from the group consisting of substituted or unsubstituted aryl groups, alkyl groups having from 1 to 18 carbon atoms and cycloaliphatic groups having from 3 to 18 carbons atoms. The substituents should be free from electron-withdrawing groups such as $NO_2$ groups, CN groups, and the like.

Examples of charge-transporting aromatic amines represented by the structural formula above include triphenylmethane, bis(4-diethylamine-2-methylphenyl)-phenylmethane; 4,4'-bis(diethylamino)-2,2'-dimethyltriphenylmethane; N,N'-bis(alkyl-phenyl)-(1,1'-biphenyl)-4,4'-diamine wherein the alkyl is, for example, methyl, ethyl, propyl, n-butyl, etc., N,N'-diphenyl-N,N'-bis(3-methylphenyl)-(1,1'biphenyl)-4,4'-diamine; and the like, dispersed in an inactive resin binder.

Any suitable inactive resin binder soluble in methylene chloride or other suitable solvents may be employed. Typical inactive resin binders soluble in methylene chloride include polycarbonate resin, polyvinylcarbazole, polyester, polyacrylate, polyether, polysulfone, and the like. Molecular weights can vary from about 20,000 to about 1,500,000. Other solvents that may dissolve these binders include tetrahydrofuran, toluene, trichloroethylene, 1,1,2-trichloroethane, 1,1,1-trichloroethane, and the like.

The preferred electrically inactive resin materials are polycarbonate resins having a molecular weight from about 20,000 to about 120,000, more preferably from about 50,000 to about 100,000. The materials most preferred as the electrically inactive resin materials are poly(4,4'-dipropylidene-diphenylene carbonate) with a molecular weight of from about 35,000 to about 40,000, available as Lexan 145 from General Electric Company; poly(4,4'-isopropylidene-diphenylene carbonate) with a molecular weight of from about 40,000 to about 45,000, available as Lexan 141 from General Electric Company; a polycarbonate resin having a molecular weight of from about 50,000 to about 100,000, available as Makrolon from Farbenfabricken Bayer A.G.; a polycarbonate resin having a molecular weight of from about 20,000 to about 50,000, available as Merlon from Mobay Chemical Company; polyether carbonates; and 4,4'-cyclohexylidene diphenyl polycarbonate. Methylene chloride solvent is a desirable component of the charge transport layer coating mixture for adequate dissolving of all the components and for its low boiling point.

The thickness of the charge transport layer may range from bout 10 micrometers to about 50 micrometers, and preferably from about 20 micrometers to about 35 micrometers. Optimum thicknesses may range from about 23 micrometers to about 31 micrometers.

The Ground Strip

The ground strip 9 may comprise a film-forming polymer binder and electrically conductive particles. Cellulose may be used to disperse the conductive particles. Any suitable electrically conductive particles may be used in the electrically conductive ground strip layer 9. The ground strip 9 may comprise materials which include those enumerated in U.S. Pat. No. 4,664,995. Typical electrically conductive particles include carbon black, graphite, copper, silver, gold, nickel, tantalum, chromium, zirconium, vanadium, niobium, indium tin oxide and the like. The electrically conductive particles may have any suitable shape. Typical shapes include irregular, granular, spherical, elliptical, cubic, flake, filament, and the like. Preferably, the electrically conductive particles should have a particle size less than the thickness of the electrically conductive ground strip layer to avoid an electrically conductive ground strip layer having an excessively irregular outer surface. An average particle size of less than about 10 micrometers generally avoids excessive protrusion of the electrically conductive particles at the outer surface of the dried ground strip layer and ensures relatively uniform dispersion of the particles throughout the matrix of the dried ground strip layer. The concentration of the conductive particles to be used in the ground strip depends on factors such as the conductivity of the specific conductive particles utilized.

The ground strip layer may have a thickness from about 7 micrometers to about 42 micrometers, and preferably from abut 14 micrometers to about 27 micrometers.

The Anti-Curl Layer

The anti-curl layer 1 is optional, and may comprise organic polymers or inorganic polymers that are electrically insulating or slightly semi-conductive. The anti-curl layer provides flatness and/or abrasion resistance.

Anti-curl layer 1 may be formed at the back side of the substrate 2, opposite to the imaging layers. The anti-curl layer may comprise a film-forming resin and an adhesion promoter polyester additive. Examples of film-forming resins include polyacrylate, polystyrene, poly(4,4'-isopropylidene diphenyl carbonate), 4,4'-cyclohexylidene diphenyl polycarbonate, and the like. Typical adhesion promoters used as additives include 49,000 (du Pont), Vitel PE-100, Vitel PE-200, Vitel PE-307 (Goodyear), and the like. Usually from about 1 to about 15 weight percent adhesion promoter is selected for film-forming resin addition. The thickness of the anti-curl layer is from about 3 micrometers to about 35 micrometers, and preferably about 14 micrometers.

The anti-curl coating may be applied as a solution prepared by dissolving the film forming resin and the adhesion promoter in a solvent such as methylene chloride. The solution is applied to the rear surface of the supporting substrate (the side opposite to the imaging layers) of the photoreceptor device by hand coating or by other methods known in the art. The coating wet film is then dried to produce the anti-curl layer 1.

The Overcoating Layer

The optional overcoating layer 8 may comprise organic polymers or inorganic polymers that are capable of transporting charge through the overcoat. The overcoating layer may range in thickness from about 2 micrometers to about 8 micrometers, and preferably from about 3 micrometers to about 6 micrometers. An optimum range of thickness is from about 3 micrometers to about 5 micrometers.

The invention will further be illustrated in the following, non-limiting examples, it being understood that these examples are intended to be illustrative only and that the invention in not intended to be limited to the materials, conditions, process parameters and the like recited therein.

COMPARATIVE EXAMPLE I

A photoconductive imaging member is prepared by providing a web of titanium coated polyester (Melinex, available from ICI Americas Inc.) substrate having a thickness of 3 mils, and applying thereto, with a gravure applicator using a production coater, a solution containing 50 grams 3-amino-propyltriethoxysilane, 50.2 grams distilled water, 15 grams acetic acid, 684.8 grams of 200 proof denatured alcohol and 200 grams heptane. This layer is dried for about 5 minutes at 135° C. in the forced air drier of the coater. The resulting blocking layer has a dry thickness of 0.05 micrometer.

An adhesive interface layer is prepared by applying a wet coating over the blocking layer, using a gravure applicator. The wet coating contains 5.0 percent by weight based on the total weight of the solution of copolyester Vitel 3550 adhesive (available from Goodyear Tire & Rubber Co.) in a 70:30 volume ratio mixture of tetrahydrofuran/cyclohexanone. The adhesive interface layer is dried for about 5 minutes at 135° in the forced air drier of the coater. The resulting adhesive interface layer has a dry thickness of 680 Angstroms.

Benzimidazole perylene, 0.32 grams, and 0.06 grams of E. I. du Pont 49,000 polyester are mixed in a 60 cc glass bottle containing 100 grams of ⅛ inch stainless steel shot and 19 cc of 7:3 tetrahydrofuran/cyclohexanone solvent mixture. The bottle is placed on a roller mill and the mixture milled for 96 hours. Thereafter, the polyester dispersion solution of benzimidazole is coated onto a 9 inch×12 inch sample cut from the coated titanium web described above using a bird applicator of ½ mil gap, followed by drying in a forced air oven at 135° C., for 20 minutes to form a charge generator layer of about 0.4 micrometer.

This benzimidazole coated member is removed from the dryer and overcoated with a charge transport layer. The charge transport layer coating solution is prepared by introducing into an amber glass bottle in a weight ratio of 1:1, N,N'-diphenyl-N,N'-bis(3-methylphenyl)-1,1'-biphenyl-4,4'-diamine and Makrolon 5705, a polycarbonate resin having a molecular weight of about 100,000 and commercially available from Farbenfabricken Bayer A.G. The resulting mixture is dissolved by adding methylene chloride to the glass bottle to form a 16 weight percent solids charge transport layer solution. This solution is applied onto the photogenerator layer by hand coating using a 3 mil gap Bird applicator to form a wet coating which upon drying at 135° C. in a forced air oven for 6 minutes gives a dried charge transport layer thickness of 24 micrometers. During the charge transport layer coating process, the humidity is controlled at or less than 15 percent.

The imaging member exhibits spontaneous upward curling. An anti-curl coating is applied to render the imaging member flat. The anti-curl coating solution is prepared in a glass bottle by dissolving 8.82 grams polycarbonate (Makrolon 5705, available from Bayer AG) and 0.09 grams copolyester adhesion promoter (Vitel PE-100, available from Goodyear Tire and Rubber Company) in 90.07 grams methylene chloride. The glass bottle is covered tightly and placed on a roll mill for about 24 hours until total dissolution of the polycarbonate and the copolyester is achieved. The anti-curl coating solution thus obtained is applied to the rear surface of the support substrate (the side opposite to the imaging layers) of the photoreceptor device by hand coating using a 3 mil gap Bird applicator. The coated wet film is dried at 135° C. in a forced air oven for about 5 minutes to produce a dry, 14 micrometers thick anti-curl layer.

EXAMPLE II

The same procedure as described in Comparative Example I is followed to prepare a photoconductive imaging member except that the 5 weight percent copolyester Vitel 3550 in the coating solution for the adhesive layer is replaced by Vitel 3550 and a polyisocyanate cross-linking agent Mondur CB-75 (Mobay Chemical Corp.) in a weight ratio of Vitel copolyester to cross-linker of 4:2. After drying, the thickness of the adhesive interface layer is 650 angstroms.

EXAMPLE III

The same procedure as described in Example II is followed to prepare a photoconductive imaging member except that the adhesive interface layer is prepared from a coating containing 10 percent by weight of copolyester Vitel 3550 and Mondur CB-75 in a weight ratio of 4:2. The thickness of the resulting dry adhesive interface layer is 1,200 angstroms.

EXAMPLE IV

The same procedure as described in Example II is followed to prepare a photoconductive imaging member except that the benzimidazole perylene is dispersed with copolyester Vitel 3550 instead of 49,000 polyester to form a charge generator layer of about 0.4 micrometers, dry thickness.

EXAMPLE V

The same procedure as described in Example IV is followed to prepared a photoconductive imaging member except that the adhesive interface layer is prepared by applying a coating containing 10 percent by weight of the copolyester Vitel 3550 and Mondur CB-75. The thickness of the resulting dry adhesive interface layer is 1,200 angstroms.

EXAMPLE VI

The same procedure as described in Example IV is followed to prepared a photoconductive imaging member except that the adhesive interface layer is prepared by applying a coating containing a copolyester Vitel 1870 as the adhesive replacing the copolyester Vitel 3550. The weight ratio of copolyester to cross-linking agent is maintained at 4:2 and the thickness of the dry cross-linked adhesive interface layer is 650 angstroms.

EXAMPLE VII

The same procedure as described in Example VI is followed to prepared a photoconductive imaging member except that the adhesive interface layer is prepared by applying a coating containing 10 percent by weight of the copolyester Vitel 1870 and the cross-linking agent Mondur CB-75. The thickness of the resulting dry cross-linked adhesive interface layer is 1,200 angstroms.

EXAMPLE VIII

The photoconductive imaging members of the Examples are evaluated for 180° peel strength. Five 0.5 inch by 6 inches imaging member samples are cut from each of comparative Example I and Examples II–VII. The charge transport layer of each imaging sample is partially stripped by using a razor blade followed by a hand peeling to about 3.5 inches from one end to expose a portion of the underlying charge generating layer. Imaging member samples are secured with charge transport layer surface toward a one inch by six inches by one-half cm. aluminum backing plate using two sided adhesive tape. The stripped end of the assembly is inserted into the upper jaw of an Instrom Tensile Tester. The free end of the partially peeled sample is inserted into the lower jaw of the Instrom Tensile Tester. The jaws are activated at a one inch per minute cross head speed, a two inch chart speed and a load range of 200 grams to peel the samples 180° for at least two inches. The load required to peel the test samples is monitored with a chart recorder. The peel strength is calculated by dividing the average load of peel by the width of the test sample.

The test results of 180° peel measurements are listed in Table II.

TABLE II

| EXAMPLE | Adhesive | Adhesive Layer Thickness (A°) | Charge Generating Layer Dispersion Formulation | 180° Peel Strength (gm/cm) |
|---|---|---|---|---|
| I | Vitel 3550/CB75* | 680 | 80% Pigment in 49,000 | 6.7 |
| II | Vitel 3550/CB75* | 650 | 80% Pigment in 49,000 | 12.8 |
| III | Vitel 3550/CB75* | 1200 | 80% Pigment in 49,000 | 21.2 |
| IV | Vitel 3550/CB75* | 650 | 80% Pigment in Vitel 3550 | 14.2 |
| V | Vitel 3550/CB75* | 1200 | 80% Pigment in Vitel 3550 | 33.5 |
| VI | Vitel 1870/CB75* | 650 | 80% Pigment in Vitel 3550 | 15.4 |
| VII | Vitel 1870/CB75* | 1200 | 80% Pigment in Vitel 3550 | 33.1 |

*Copolyester and polyisocyanate cross-linker ratio at 4:2

The control sample of Comparative Example I with benzimidazole perylene pigment in polyester shows poor peel strength and is unsuitable for use. In contrast, the compositions having an adhesive layer with a cross-linking agent are characterized by improved peel strength with varying binders in the charge generating layer and varying adhesive layer resins and adhesive layer thicknesses.

EXAMPLE IX

The photoconductive imaging members fabricated using the present invention concept as described in Examples II–VII along with the control imaging member of Comparative Example I are examined for their electrophotographic performances after 50,000 cycles of testing using a xerographic scanner at 21° C. and 40% relative humidity. Charge acceptance, dark decay potential, background and residual voltages, photosensitivity, photo-induced discharge characteristics, and long-term electrical cyclic stability for all Examples II–VII are equivalent to those obtained for the control imaging member counterpart of Comparative Example I. These results indicate that the photoelectrical integrity of the original photoconductive imaging member is maintained with the presence of the cross-linking agent in the adhesive layer.

While the invention has been described with reference to particular preferred embodiments, the invention is not limited to the specific examples given, and other embodiments and modifications can be made by those skilled in the art without departing from the spirit and scope of the invention and claims.

What is claimed is:

1. An electrophotographic imaging member comprising an at least partially cross-linked adhesive layer comprising an adhesive and a cross-linking agent and a solution coated charge generating layer comprising a film forming binder and a photogenerating pigment, wherein at least a portion of the adhesive layer is (a) interlocked by mechanical polymer entanglement with at least a portion of the binder, (b) cross-linked by chemical bonding to at least a portion of the binder or (c) interlocked by mechanical polymer entanglement with at least a portion of the binder and is cross-linked by chemical bonding to at least a portion of the binder.

2. The electrophotographic imaging member of claim 1, wherein the film forming binder is selected from the group consisting of polycarbonates, polyarylates, polyacrylates, polysulfones, polyvinyl chloride, polyvinylbutyral, polyurethanes, polysiloxanes and styrene-butadiene copolymers.

3. An electrophotographic imaging member comprising a charge generating layer and an adhesive layer comprising an adhesive and a cross-linking agent, wherein said adhesive layer is interfacially cross-linked to a binder resin of said charge generating layer.

4. The electrophotographic imaging member of claim 3, wherein the charge generating layer comprises a film forming binder of a first polyester resin and a photogenerating pigment.

5. The electrophotographic imaging member of claim 4, wherein said adhesive layer comprises a second polyester resin.

6. The electrophotographic imaging member of claim 5, wherein said adhesive layer is interfacially cross-linked to said charge generating layer by a reaction product of said first and second polyester resins with said cross-linking agent.

7. The electrophotographic imaging member of claim 5, wherein said first polyester resin is the same as said second polyester resin.

8. The electrophotographic imaging member of claim 6, wherein said cross-linking agent is selected from the group consisting of polyisocyanates, melamines, melamine/ureaformaldehyde resins, peroxides and polymethyl acrylaminoglycoate methyl ether.

9. The electrophotographic imaging member of claim 5, wherein said second polyester resin comprises a reaction product of different diacids and an alphatic diol.

10. The electrophotographic imaging member according to claim 8, wherein said photogenerating pigment is selected from the group consisting of phthalocyanines and benzimidazole perylenes.

11. The electrophotographic imaging member of claim 10, wherein said photogenerating pigment comprises a benzimidazole perylene.

12. The electrophotographic imaging member of claim 11, wherein said benzimidazole perylene is present in from 50 to 90 weight percent based on the total weight of the charge generating layer.

13. The electrophotographic imaging member of claim 4, wherein said charge generating layer comprises coated benzimidazole perylene applied from a dispersion in a polymer/solvent.

14. A process for preparing an electrophotographic imaging member comprising applying a charge generating layer to an adhesive layer comprising an adhesive and a cross-linking agent and cross-linking a binder resin of the charge generating layer to the adhesive layer.

15. The process of claim 14, wherein said cross-linking step comprises reacting said cross-linking agent with the binder resin of the charge generating layer.

16. The process of claim 15, wherein said cross-linking agent is a polyisocyanate.

17. The process of claim 15, wherein said cross-linking agent is selected from the group consisting of polyisocyanates, melamines, melamine/ureaformaldehyde resins, peroxides and polymethyl acrylaminoglycoate methyl ether.

18. The process of claim 14, comprising mixing a cross-linking agent with the adhesive layer and reacting said cross-linking agent with said adhesive layer and said binder resin to produce interfacial cross-linking.

19. The process of claim 14, wherein said cross-linking step comprises first reacting said cross-linking agent with a polyester resin in the adhesive layer and subsequently reacting said cross-linking agent with said binder resin to produce interfacial cross-linking.

20. The process of claim 19, wherein said adhesive layer comprises a polyester resin reaction product of at least one diacid and at least one diol.

21. The process of claim 14, wherein said charge generating layer comprises a film forming polyester resin binder and a photogenerating pigment.

22. The process of claim 21, wherein said photogenerating pigment is selected from the group consisting of phthalocyanines and benzimidazole perylenes.

23. The process of claim 21, wherein said photogenerating pigment comprises a benzimidazole perylene.

24. The process of claim 14, wherein said applying step comprises solution coating said charge generating layer onto said adhesive layer.

25. The process of claim 14, wherein said adhesive layer contains a cross-linking agent and a first polyester resin, said adhesive layer is heated to link said agent to said resin by chemical reaction of functional groups, said charge generating layer comprises a film forming binder of a second polyester resin and a photogenerating pigment, and said charge generating layer and adhesive layer are heated together to link said agent of said adhesive layer to said second polyester resin by reaction of functional groups thereby forming an interfacial cross-linking between said layers by said cross-linking agent.

26. The process of claim 25, wherein said adhesive layer is heated to a temperature between 50° and 150° C. to link said agent to said first polyester.

27. The process of claim 25, wherein said charge generating layer and adhesive layer are heated to a temperature of between 50° and 150° C. to link said agent to said second polyester resin.

28. The process of claim 25, wherein said charge generating layer and adhesive layer are heated to a temperature of between 120° and 135° C. to link said agent to said second polyester resin.

29. A process for preparing an electrophotographic imaging member comprising first at least partially reacting a cross-linking agent with a polyester resin in an adhesive layer and subsequently applying a charge generating layer by solution coating onto the adhesive layer.

30. The process of claim 29, wherein said charge generating layer comprises a film forming polyester resin binder and a photogenerating pigment.

31. The process of claim 29, wherein said adhesive layer comprises a polyester resin reaction product of at least one diacid and at least one diol.

32. The process of claim 29, wherein said cross-linking agent is a polyisocyanate.

33. The process of claim 29, wherein said cross-linking agent is selected from the group consisting of polyisocyanates, melamines, melamine/ureaformaldehyde resins, peroxides and polymethyl acrylaminoglycoate methyl ether.

34. The process of claim 30, wherein said photogenerating pigment is selected from the group consisting of phthalocyanines and benzimidazole perylenes.

35. The process of claim 30, wherein said photogenerating pigment comprises a benzimidazole perylene.

* * * * *